US007143689B2

(12) United States Patent
Dopfer et al.

(10) Patent No.: US 7,143,689 B2
(45) Date of Patent: Dec. 5, 2006

(54) STRAPPING OF BANK NOTES

(75) Inventors: Peter Dopfer, Geltendorf (DE); Frank Hofmann, Dachau (DE); Peter Osterberger, München (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 11/120,989

(22) Filed: May 4, 2005

(65) Prior Publication Data

US 2005/0188861 A1 Sep. 1, 2005

Related U.S. Application Data

(62) Division of application No. 10/456,681, filed on Jun. 9, 2003.

(30) Foreign Application Priority Data

Jun. 10, 2002 (DE) ..... 102 25 705

(51) Int. Cl.
*B65B 13/04* (2006.01)
*B65B 13/32* (2006.01)

(52) U.S. Cl. ..... 100/26; 100/6; 100/7; 100/29; 100/33 R; 53/589

(58) Field of Classification Search ..... 100/6, 100/7, 8, 26, 29, 30, 32, 33 R, 33 PB; 53/540, 53/542, 587, 588, 589, 582; 270/58.08, 58.12
See application file for complete search history.

(56) References Cited

U.S. PATENT DOCUMENTS

| | | | | |
|---|---|---|---|---|
| 2,853,938 | A | 9/1958 | Hall et al. | |
| 3,470,814 | A | 10/1969 | Tschappu | |
| 4,271,655 | A | 6/1981 | Nagayoshi | |
| 4,661,185 | A | 4/1987 | Kobiella | |
| 5,890,423 | A | 4/1999 | Lih | |
| 5,996,314 | A | 12/1999 | Pennini et al. | |
| 6,328,087 | B1 * | 12/2001 | Finzo et al. | 156/494 |
| 6,513,303 | B1 * | 2/2003 | Neri | 53/399 |
| 6,550,221 | B1 | 4/2003 | Neri | |
| 6,922,973 | B1 * | 8/2005 | Hofmann et al. | 53/399 |

FOREIGN PATENT DOCUMENTS

| | | |
|---|---|---|
| DE | 385628 | 11/1923 |
| DE | 4443252 | 5/1996 |
| DE | 19943486 | 3/2001 |
| JP | 07-040405 | 7/1995 |
| JP | 11-26331 | 9/1999 |
| WO | 00/56606 | 9/2000 |

OTHER PUBLICATIONS

Translation copy of JP 11263311 A.*
English Abstract of JP 11-26331 published Sep. 28, 1999.

* cited by examiner

*Primary Examiner*—Henry Bennett
*Assistant Examiner*—Jimmy T. Nguyen
(74) *Attorney, Agent, or Firm*—Bacon & Thomas, PLLC

(57) ABSTRACT

The invention relates to a strapper for bank notes and a bank note processing apparatus having such a strapper. Especially reliable and fast strapping is possible if a guide for forming a strap loop around a bank-note bundle to be strapped that is brought into an inside area surrounded by the guide has elements for holding the strap only in its lateral edge areas when it is inserted into the guide, and when the strap is pulled it can be pulled together tightly out of the guide into the inside area around the bank-note bundle located therein.

19 Claims, 4 Drawing Sheets

STRAPPING OF BANK NOTES

CROSS REFERENCE TO RELATED APPLICATION

This application is a divisional application of U.S. patent application Ser. No. 10/456,681 filed on Jun. 9, 2003.

BACKGROUND

This invention relates to a strapper for bank notes and a bank note processing apparatus having such a strapper.

DE 199 43 496 A1 from the applicant discloses a deposit apparatus for bank notes wherein bank notes during stacking by a stacking wheel are deposited either directly loose in a container or are previously strapped. In the latter case, bank notes are stacked on a collecting plate located above the container. The collecting plate is then moved laterally into a strapper, a strap pulled over the bank-note packet and movable collecting plate, the plate pushed back beyond the area of the container, and the strapped stack stripped off there and deposited in the container. Print data relating to the strapped bank-note packet are printed on the strap immediately during or after strapping. The strapper is moreover designed to swivel in the form of a door of a housing of the apparatus.

SUMMARY

On these premises, the problem of the present invention is to provide an improved strapper for bank notes and a bank note processing apparatus having such a strapper.

One of the ideas of the present invention is thus that a guide for forming a strap loop around a bank-note bundle to be strapped that is brought into an inside area surrounded by the guide has elements permitting the strap inserted into the guide to be held only in its lateral edge areas, and when the strap is pulled it can be pulled together tightly out of the guide into the inside area around the bank-note bundle located therein.

It is thus possible in especially reliable and quick fashion to preform a strap loop in the guide that can then, merely by pulling on this preformed loop, be pulled together firmly around the bank-note packet inwardly through an opening between the lateral guide elements and tightened.

It is emphasized that this is only one of the advantageous ideas of the present invention and that the individual features of the dependent claims and/or the examples stated in the description can be used advantageously in any combination, also completely or at least partly independently of each other and of the subject matter of the main claims.

This also applies for example to the ideas of the side walls of a strap guide that are movable apart laterally, the curved deposit surface for bank notes to be strapped, the clamping element preferably having a through hole for the strap, providing a separate welding plate, vibrating bank notes stacked on a bank-note tray in two different directions, and using a fully automatic strapping apparatus as a hand strapper.

Further advantages of the present invention will result from the examples to be explained in more detail with reference to the enclosed drawings.

DETAILED DESCRIPTION OF VARIOUS EMBODIMENTS

Figure 2:
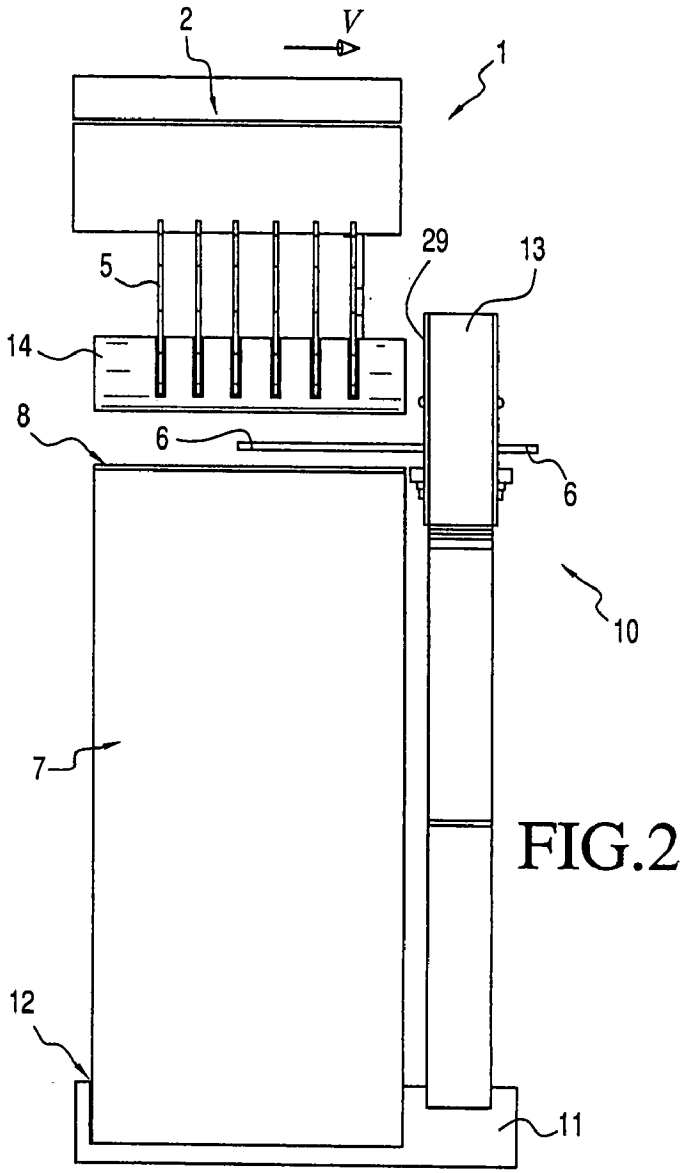
FIG. 2 shows a schematic side view of the deposit device with a strapper according to FIG. 1.

In the following, various ideas of the present invention will be explained in more detail with respect to an example for bank note processing apparatus 1 according to FIGS. 1 to 5. This apparatus may be sorting apparatus 1 or any other type of processing apparatus for bundling and strapping bank notes. A bundle refers here to a stack of one or in particular more bank notes. For clarity's sake, components of such an apparatus 1 that are known in the art and not essential for understanding the invention are omitted or shown only schematically in the drawing.

Figure 1:
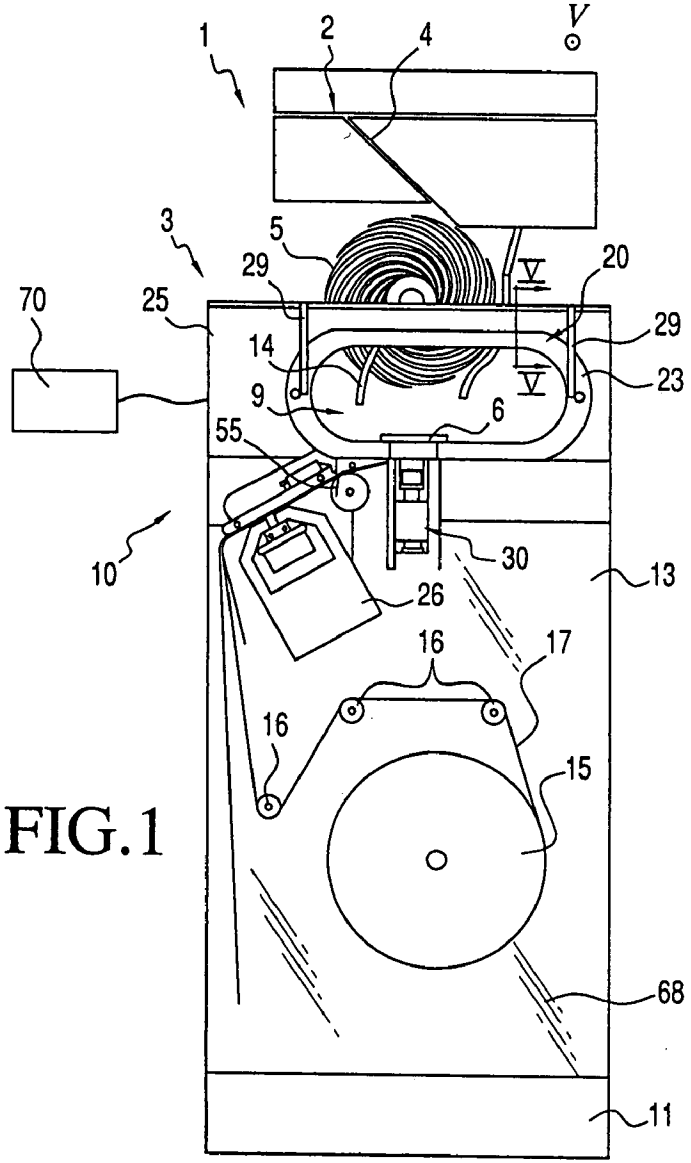
FIG. 1 shows a schematic front view of a deposit device with a strapper of a bank note processing apparatus.

In the case of sorting apparatus 1, apparatus 1 will include e.g. an input for inputting a loose stack of bank notes and a test device for testing single drawn-in bank notes, which is not shown, and transport device 2 for supplying tested bank notes to one of a plurality of deposit devices 3 in dependence on given sorting criteria. A plurality of deposit devices 3 can be disposed side by side in sorting apparatus 1, a single one of which is shown in FIG. 1 in a front view facing the user, and in FIG. 2 in a side view. Via a diverter and transport channel 4, bank notes can be supplied singly to deposit device 3 and stacked there by a stacking device, such as stacking wheel 5 with stripping plate 14.

As described in more detail in DE 199 43 486 A1 from the applicant, bank notes can either be deposited in an upwardly open storage container, such as cassette 7, located below stacking wheel 5, or alternatively stacked loose for strapping on collecting plate 6 which is moved for this purpose by an actuator (not shown) to a position located directly below stacking wheel 5 and above opening 8 of cassette 7. Shifting collecting plate 6 to a position corresponding roughly to that according to FIG. 2 shifts the loose stacked bank notes forward into passing area 9 of strapper 10 in which they are subsequently strapped.

Strapper 10, whose components will be described more precisely in the following, is fastened to linear pull-out 11 also having a fastening device or receiving means 12 for insertion of cassette 7. Linear pull-out 11 can be pulled out of the housing 68 of apparatus 1 forward, in the linear direction V. The remaining components of apparatus 1, such as components 2–6, are firmly installed in the housing 68 and not pulled out at the same time.

As mentioned above, in the known solution according to DE 199 43 486 A1 the strapper is fastened, in contrast, to the front side of the machine in a swiveling door. Changing cassettes is more difficult because the cassette is not moved out of the housing simultaneously by opening the door but must be removed from the interior thereof with little free space.

The inventive apparatus, however, makes it possible that after linear pull-out 11 is pulled out, cassette 7 can be removed easily, e.g. by being tilted away laterally, and moreover there is ready accessibility to the interior of the housing of apparatus 1, e.g. for maintenance work. Since strapper 10 is disposed on the front side of apparatus 1, it is especially easy to replace or change strap material.

Moreover, the inventive variant with linear pull-out 11 has the further advantage that a plurality of deposit devices 3 shown in FIG. 1 can be installed close together side by side, if required, to keep the dimensions of apparatus 1 small. Such a compact assembly is impossible in the known system with a swiveling door, since the doors, in particular their outer lining, always have a given thickness that prevents complete opening when adjacent deposit devices 3 are present.

Figures 3A, 3B, 3C, 3D:
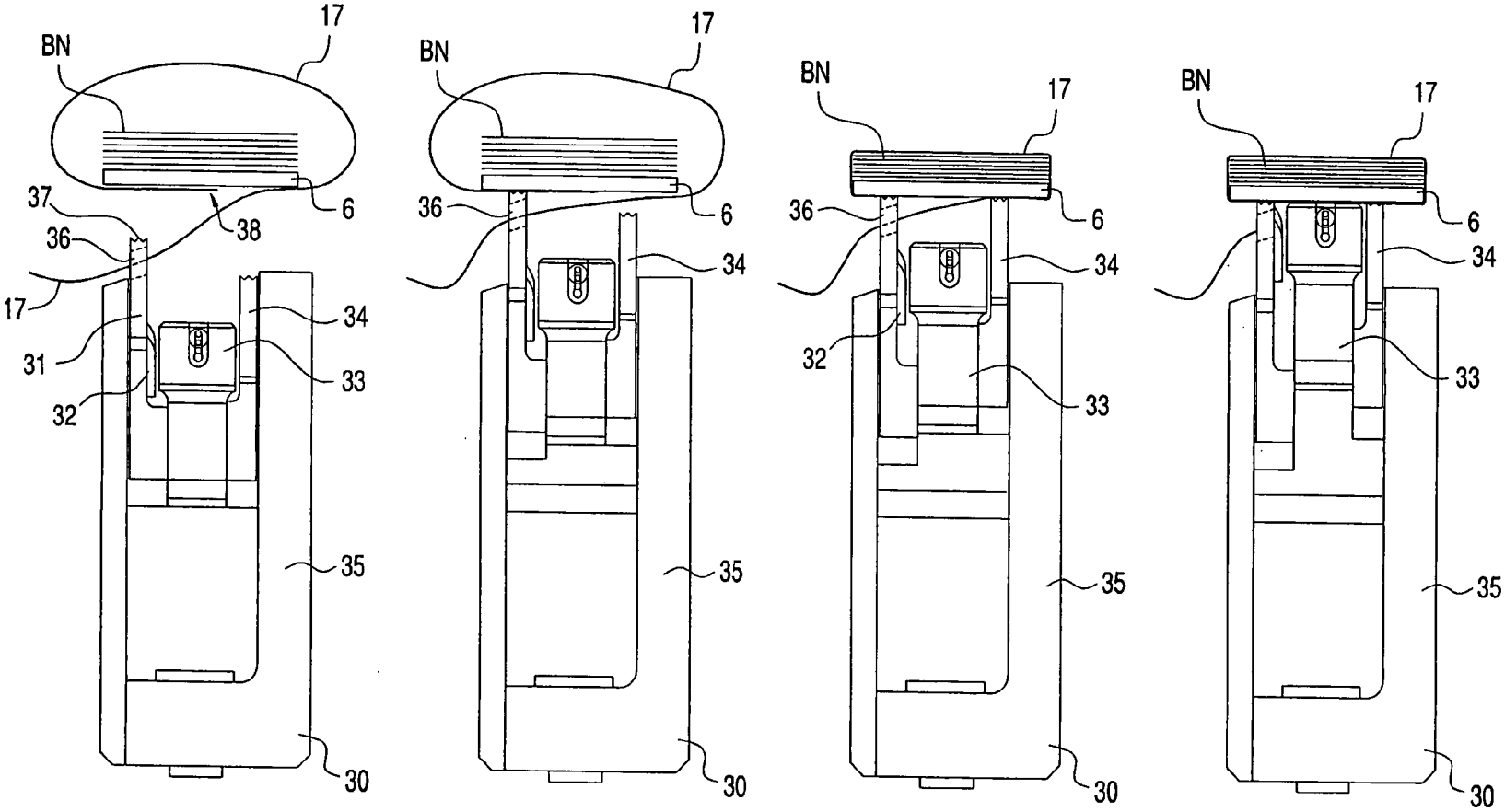
FIGS. 3*a*–3*d* show schematic front views of a part of the strapper according to FIG. 1 in four consecutive operating states.
Figure 4:
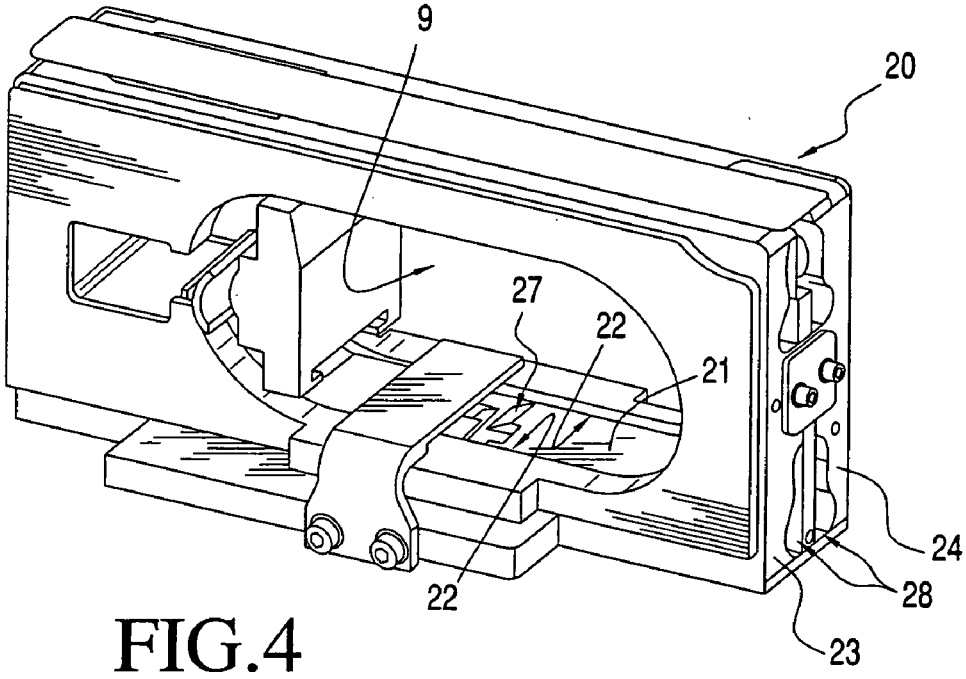
FIG. 4 shows a schematic perspective view of a guide of the strapper according to FIG. 1.
Figure 5:
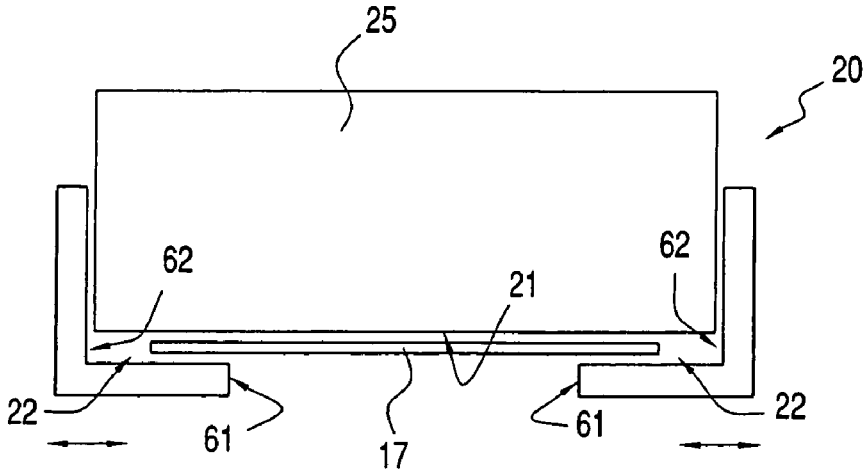
FIG. 5 shows a schematic sectional view of the guide according to FIGS. 1 and 4, along line V—V according to FIG. 1.

Strapper 10 is constructed as follows. It has rack 13 connected firmly or detachably with linear pull-out 11. On the front side, rack 13 can have a cover, which for example has only passing area 9 as an opening. The figures do not show this optional cover. Rack 13 firstly has strap delivery spool 15 fastened replaceably thereto. Strapping tape 17, or strap 17 for short, unwound from delivery spool 15 can be supplied via deflection rollers 16 to guide 20 of strapper 10. Said guide surrounds passing area 9 approximately in a loop shape. Passing area 9 is consequently inside area 9 of strapper 10, said inside area being surrounded by loop-shaped guide 20 and receiving a bank-note bundle to be strapped. As to be recognized in particular in the perspective view according to FIG. 4 and the cross-sectional view according to FIG. 5, guide 20 includes sliding surface 21 on which the strap can slide while being guided laterally between two grooves 22 for wrapping around collecting plate 6 with bank notes BN stacked thereon which is inserted into passing area 9 and not shown in FIGS. 4 and 5. In FIG. 2 said lateral guide grooves 22 are thus located on the right and left sides of rack 13. In FIG. 3*a* the course of strap 17 makes clear the course of guide grooves 22 in which strap 17 is mounted laterally in this operating position. The strap is thus guided through grooves 22 only along its lateral edge areas, while the strap is free in the area between groove projections 61.

Further, strapper 10 includes printer 26 that is disposed firmly on rack 13 before guide 20 and used for printing strap 17, before it is supplied to guide 20, with data about the bank notes to be strapped immediately thereafter. Printing will preferably be done only when all bank notes to be strapped, e.g. a predetermined number of 100 bank notes for example, have already been stacked on collecting plate 6. This has the advantage that e.g. before a change of denomination whereby fewer than 100 bank notes are stacked, no strap that might then already be printed faultily need be predispensed and cut off.

Strapper 10 moreover includes multifunctional tool 30 fastened in rack 13 and used for clamping, welding and cutting the strap during the strapping process, its structure and function being apparent especially from FIGS. 3*a* to 3*d*. Multifunctional tool 30 has first clamping element 31, cutting element 32, welding element 33 and second clamping element 34 that are mounted in vertically displaceable fashion in frame 35. Left-hand clamping element 31 has through hole 36 in the upper area through which strap 17 can be pushed in guided fashion, as indicated by the dashed line.

At the beginning of a strapping process, multifunctional tool 30 is spaced downward from collecting plate 6. By active drive of deflection roller 55, which is directly upstream of guide 20, the strap is unrolled in the clockwise direction from delivery spool 15, the front end of strap 17 passes through a guide (not shown) through hole 36 of clamping element 31 and then runs in area 27 into grooves 22 of guide 20 to form a strap loop. Further guide plates (not shown) ensure precise transfer of strap 17 between the individual components.

FIG. 3*a* shows the state in which strap 17 has already run around completely in guide 20 while laterally guided in grooves 22, so that front end 38 of strap 17 is located immediately below collecting plate 6. Now multifunctional tool 30 or its components 31 to 34 are shifted upward by an associated actuator, during or after insertion of strap 17 a little further into guide 20. Shifting multifunctional tool 30 or its components 31 to 34 is done until upper side 37 of clamping element 31, through whose hole 36 strap 17 has been pushed, urges a front area of strap 17 against the underside of collecting plate 6, thus clamping strap 17 in this area, as corresponds to the representation according to FIG. 3*b*. An alternative variant with separate welding plate 43 will be described more precisely in the following in particular in connection with FIG. 8.

Subsequently, the direction of rotation of the drive of deflection roller 55 is reversed to the counterclockwise direction, causing strap 17 to be pulled out of guide 20 through hole 36, thereby tightening strap 17 so that it tightly encloses collecting plate 6 with bank notes BN stacked thereon. The components 32 to 34 are shifted upward relative to clamping element 31 already located in the stop position, i.e. clamping position, until the upper side of second clamping element 34 also clamps strap 17 wound around collecting plate 6 at a further position, as illustrated in FIG. 3*c*.

Then firmly interconnected cutting and welding elements 32 and 33 are shifted further upward relative to the two clamping elements 31, 34 located in the stop state, i.e. the clamping state, thereby first cutting off strap 17 in the area of through hole 36 and urging the cut-offend through welding unit 33 against the underside of front end 38 of strap 17, the two ends then being welded together by the supply of heat, as shown in FIG. 3*d*. Cutting and welding elements 32 and 33 are also movable toward each other slightly in the vertical direction for example by bias with springs of different strength.

In the present case the welding unit is e.g. welding die 33. Subsequently, multifunctional tool 30 is shifted downward again, thereby ending the strapping process. In accordance with the procedure in DE 199 43 496 A1, collecting plate 6 can now be moved back to the area above cassette 7 and bank-note bundle BN stripped off to be deposited in cassette 7 through opening 8.

As mentioned above, strap 17 slides at the beginning of the strapping process on sliding surface 21 in guide 20, being laterally guided in grooves 22, as indicated in FIGS. 3*a* and 3*b*. To permit the strap to be tightened by withdrawal in the transition from FIG. 3*b* to FIG. 3*c*, strap 17 must be moved out of guide grooves 22. It is basically conceivable for walls 23, 24 having grooves 22 to be connected integrally or otherwise rigidly with each other and wall 25 of sliding surface 25, and for strap 17 to be deformed upon withdrawal and thus jump out of grooves 22 to be able to lie tightly against bank-note packet BN.

Since this procedure is trouble-prone, an alternative is for one side wall 23, 24 or both side walls 23, 24 having grooves 22 to be movable apart preferably laterally. Especially preferably, this moving apart is effected passively, i.e. without separate active servomotors for side walls 23, 24. Thus, side walls 23, 24 can be held together e.g. only by at least one clamp 29 embracing them and wall 25 as a spring, as shown by way of example in FIGS. 1 and 2. Sidewalls 23, 24 can be opened solely by the withdrawal and thus tightening of strap 17 against the spring force of clamp 29 to release strap 17 from grooves 22.

Further alternatives are conceivable for opening grooves 22 without a separate drive. Thus, multifunctional tool 30 can be rigidly connected with a mechanism that, when multifunctional tool 30 is shifted upward, engages a gap between the two side walls 23, 24 either directly e.g. in the form of a wedge, to urge the walls apart. Said engagement can be effected e.g. on the right and/or left edge areas of guide 20 in the views according to FIGS. 1 and 4. Further, it is possible that when multifunctional tool 30 is shifted e.g. a wedge-shaped rod is urged upward, thereby pressing on balls mounted between side walls 23, 24 in their edge areas in gap 28 and urging them and thus side walls 23, 24 outward.

In the former variant with nonadjustable side walls 23, 24, it is necessary for tightening strap 17 that strap 17 is guided in grooves 22 only along its lateral edge areas while being free in the area therebetween, i.e. the area between the two groove projections 61. In the cases where side walls 23, 24 are movable apart, this construction is also especially preferred in order to permit the necessary amount of displacement to be kept small, but it is basically also conceivable that when strap 17 is supplied the free space between groove projections 61 is smaller or nonexistent and strap 17 can thus be inserted into guide 20 with complete guidance, i.e. from all sides.

It is emphasized that grooves 22 for lateral guidance refer not only to depressions in side walls 23, 24, but side walls 23, 24 can also be outwardly open and have a passage in this area. In the view according to FIG. 5, wall areas 62 are e.g. lacking in this case. Such a guide only between wall areas 21 and 62 is possible especially when strap 17 is already supplied in directed fashion to guide 20 in the transport direction.

Hereinabove, bank note processing apparatus 1 was described in different variants with reference to FIGS. 1 to 5. Numerous further alternatives are conceivable.

To prevent bank notes from slipping or dropping during stacking or shifting of collecting plate 6, they can be pressed together by a clamping element pressing on them from above.

Additionally or alternatively, there can also be lateral limiting walls for collecting plate 6 that limit the stacking surface of collecting plate 6 in the longitudinal anchor transverse direction and can serve e.g. to prevent the upper bank notes from dropping while a stacking process is underway. All or at least some of the lateral limiting walls will preferably be designed to be adjustable in position. Adjustment can fulfill two functions. Firstly, it can serve to adjust the format, i.e. the size of the stacking surface, for example in dependence on the denomination of the bank notes to be subsequently stacked. Alternatively or additionally, it can serve to set the limiting walls vibrating to thereby support flush alignment of bank notes during stacking.

Figure 6:
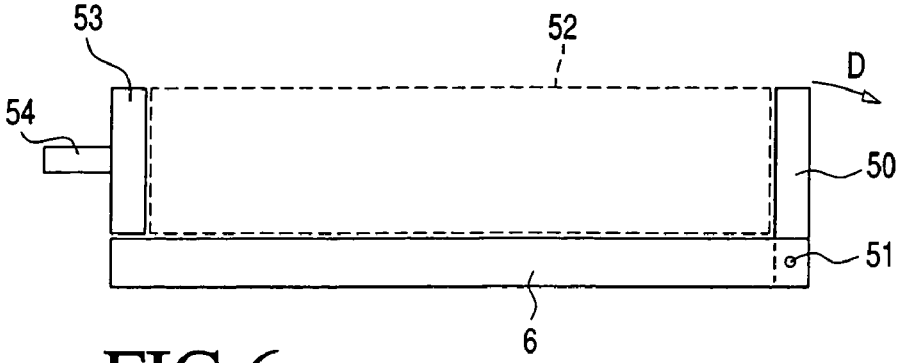
FIG. 6 shows a schematic view of an alternative collecting plate of a deposit device.

FIG. 6 shows a corresponding example. Collecting plate 6 has limiting walls on several sides, at least two of which are not themselves part of collecting plate 6. In FIG. 6 these are back wall 52 and left wall 53. The latter are fastened to a housing of apparatus 1 so as to limit the stacking surface of collecting plate 6 in a stacking position in which bank notes can be stacked on collecting plate 6 e.g. by stacking wheel 5. Wall 53 is not simultaneously moved when the collecting plate is shifted into the strapping position, e.g. in accordance with the position according to FIG. 2. Walls 52, 53 are set vibrating by actuator 54 during stacking. Preferred vibration frequencies are in an order of magnitude of a few hertz, e.g. from 3 to 5 hertz. To prevent slipping down during vibration, an opposing wall will be connected, likewise loosely or alternatively firmly, with collecting plate 6 on each opposite side of collecting plate 6. On the front side facing the user of apparatus 1, i.e. in the right-hand area of the view according to FIG. 6, this is e.g. flap 50 as a further one of the limiting walls. Said flap is fastened to collecting plate 6 and mounted pivotally around axle 51 in the direction of arrow D. Thus, the bank notes are not only held reliably on collecting plate 6, but the user also has easy access to the stacked bank notes after opening flap 50, e.g. in case of a disturbance. Vibration in two mutually perpendicular directions produces especially effective flush alignment of bank notes in all directions, which is very advantageous during subsequent strapping in contrast to vibration in only one direction.

In the hitherto described embodiment, bank notes BN to be strapped are stacked on flat collecting plate 6. Strap 17 is then pulled around collecting plate 6 with banknote packet BN located thereon and collecting plate 6 subsequently pulled out of closed strap 17.

However, this causes the strapping to be loosened after removal of collecting plate 6. To minimize this effect, collecting plate 6 must be as thin as possible, which significantly reduces the mechanical loading capacity of collecting plate 6.

Figure 7:
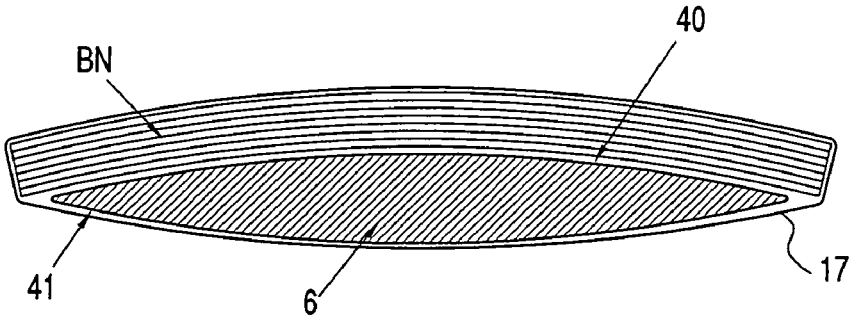
FIG. 7 shows a schematic sectional view of a collecting plate with a curved surface for stacked deposit of bank notes to be strapped.

Therefore, surface 40 of collecting plate 6 on which bank notes BN to be strapped are deposited in a loose stack preferably has a curved design. This is illustrated by way of example in FIG. 7. The collecting plate is thus curved on the stacking side, i.e. surface 40. This has the following advantage; the bank notes BN are likewise strapped in a curved position on curved surface 40 of collecting plate 6 after firm tightening of strap 17. After removal of collecting plate 6 from closed strap 17, bank notes RN can then be bent back into the flat stacking position without the strapping being loosened because the strap would be too long. Collecting plate 6 can therefore have a thicker and mechanically more stable design, and moreover its geometry be suitably chosen to selectively adjust the tightness of strap 17. Since curving of the bank notes is effected by the action of the strap itself, no additional clamping or bending element is required, which greatly simplifies the constructional effort.

Figure 8:
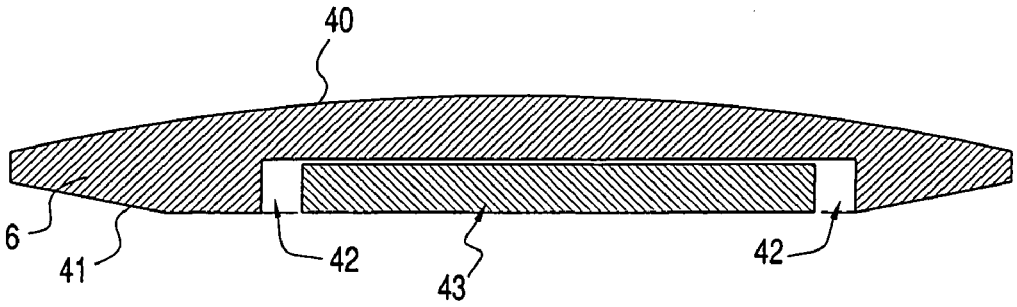
FIG. 8 shows a schematic sectional view of a different collecting plate with a curved surface for stacked deposit of bank notes to be strapped and with a gap for a welding plate.

FIG. 8 shows a further alternative. In underside 41 of collecting plate 6, which is likewise curved as in FIG. 7, there is depression 42 having the following function. In the example according to FIG. 3, welding die 33 must press firmly against the underside of collecting plate 6 to weld together the cut-off ends of the strap. This can lead to undesirable bending and thus strong wear, in particular with thin collecting plates 6. The alternative according to FIG. 8, in contrast, is based on the idea of providing opposing element 43 separate from collecting plate 6 and rigidly mounted on rack 13, and urging welding die 33 against rigidly mounted opposing element 43, thereby avoiding undesirable mechanical load on movable collecting plate 6. In the special case of FIG. 6 this opposing element is flat welding plate 43 onto which depression 42 of collecting plate 6 can be pushed as well. Welding plate 43 is likewise shown in FIG. 4 for clarity's sake.

A further special embodiment permits strapper 10 in apparatus 1 also to be used as a hand strapper. This application is possible because strapper 10 is located on the side of apparatus 1 facing the user. In this case, strapper 10 or apparatus 1 will have an operating unit 70 by which a user can initiate an operating process even when apparatus 1 itself is not stacking any bank notes.

In particular, this strapping process controlled by the user can preferably include a step of moving out collecting plate 6 to the strapping position approximately in accordance with FIG. 2, in order to place the bank-note packet to be strapped on collecting plate 6 located in passing area 9 by hand in this position and then, through a further operating input, start the strapping process in accordance with the sequence of FIGS. 3*a* to 3*d*. When strapping is completed, the packet can be removed by hand or placed in cassette 7 in accordance with the described procedure in case of fully automatic stacking and strapping.

Besides fully automatic strapping of bank notes, whereby the arriving transport and strapping of bank notes are effected automatically without manual intervention, machine 1 can consequently be used additionally as a hand strapper e.g. in processing breaks, e.g. so that bank notes to be reworked by hand can be quickly strapped on the same machine.

Preferably, it is moreover possible for the user to input data via the operating unit 70 that are printed on strap 17 by printer 26. Alternatively to depositing the bank-note bundle to be strapped on moved-out collecting plate 6, it can also be provided that the user inserts the packet himself into passing area 9 from outside when collecting plate 6 is moved in, i.e. has not passed through passing area 9, and holds the packet e.g. himself during strapping.

While it was described hereinabove that both loose and strapped bank notes can be deposited in common cassette 7, it can also be provided that there are different bins for different bank notes. Thus, there can be at least one bin 7 for loose bank notes and at least one further cassette, disposed e.g. behind cassette 7, i.e. to the left thereof in FIG. 2, for strapped bank-note bundles, to which the bank notes are moved e.g. by collecting plate 6 after strapping.

To prevent injuries during operation of the apparatus, in particular when the user triggers the strapping process or at least individual concomitant steps, such as predispensing the strap to guide 20, manually by input means, e.g. by pressing a button, it can be provided that a further input means, e.g. a further input button, is mounted on the apparatus beside the aforementioned input means and spaced more than a handbreadth therefrom. This is intended to ensure that the operator must simultaneously press the buttons with both hands during the action so that no hand is free to reach inadvertently into the strapping guide.

The invention claimed is:

1. A strapper configured to strap a plurality of bank notes, comprising:

a rack with a guide;

an inside area surrounded by the guide, wherein said guide is arranged to form a strap loop around a bundle of bank notes placed in the inside area, and includes strap holding elements arranged to hold a strap only at lateral edge areas thereof upon insertion of the strap into the guide, whereby after insertion of the strap in the guide, the strap is pulled out of the guide into the inside area around the bank-note bundle; and a collecting plate having a depression on a bottom surface and adapted to be brought into the inside area for depositing thereon the bank-note bundle, the collecting plate having a convex deposit surface for receiving the bank-note bundle such that the bank notes are strapped in a curved position by tightening the strap; and a welding plate separate from the collecting plate, and the welding plate rigidly mounted on the rack and arranged for contact with a welding element provided for welding portions of the strap, the depression of the collecting plate being slidable onto the welding plate.

2. The strapper according to claim 1, further comprising a cutting element arranged to cut the strap from a strap supply device, the cutting element being displaceable by automatic control with respect to the guide.

3. The strapper according to claim 1, further comprising at least one clamping element arranged to clamp the strap, the at least one clamping element being displaceable by automatic control with respect to the guide.

4. The strapper according to claim 1, wherein the welding element is configured for welding two strap areas to form a closed strap loop, the welding element being displaceable by automatic control with respect to the guide.

5. The strapper according to claim 3, wherein the at least one clamping element has a through hole arranged to permit insertion of the strap into the guide and guidance therethrough.

6. The strapper according to claim 1, wherein the strapper includes means for automatically inserting the strap into the guide and/or automatically pulling the strap out of the guide.

7. A strapper for bank notes, comprising:

a rack with a guide;

an inside area surrounded by the guide, wherein said guide is arranged to form a strap loop around a bank-note bundle placed in the inside area, and includes strap holding elements arranged to hold a strap only at lateral edge areas thereof upon insertion of the strap into the guide, wherein after insertion of the strap in the guide, the strap is pulled out of the guide into the inside area around the bank-note bundle;

a collecting plate arranged to support the bank-note bundle and having a depression formed on a bottom surface thereof; and a separate welding plate rigidly mounted on the rack, the welding plate is received within the depression of the collecting plate and arranged for contact with a welding element provided for welding portions of the strap, the collecting plate being slideable on the welding plate.

8. The strapper according to claim 7, wherein the strapper includes means for automatically inserting the strap into the guide and/or automatically pulling the strap out of the guide.

9. The strapper according to claim 7, further comprising a cutting element arranged to cut the strap from a strap supply device, the cutting element being displaceable by automatic control with respect to the guide.

10. The strapper according to claim 7, further comprising at least one clamping element arranged to clamp the strap, the at least one clamping element being displaceable by automatic control with respect to the guide.

11. The strapper according to claim 7, wherein the welding element is configured to weld two strap areas to form a closed strap loop, the welding element being displaceable by automatic control with respect to the guide.

12. A bank note processing machine, comprising:

a transport device arranged to transport a plurality of bank notes; and a strapper configured to strap a plurality of bank notes and including a rack with a guide, an inside area surrounded by the guide, and a collecting plate having a depression on a bottom surface thereof and adapted to be brought into the inside area for depositing thereon a bundle of bank notes, and a separate welding plate rigidly mounted on the rack, the welding plate is received within the depression of the collecting plate and the welding plate is arranged for contact with a welding element provided for welding portions of a strap, the collecting plate being slidable on the welding plate;

wherein said guide is arranged to form a strap loop around the bundle of bank notes placed in the inside area, and includes strap holding elements arranged to hold the strap only at lateral edge areas thereof upon insertion of the strap into the guide, whereby after insertion of the strap in the guide, the strap is pulled out of the guide into the inside area around the bank-note bundle;

wherein the collecting plate has a convex deposit surface for receiving the bank-note bundle such that the bank notes are strapped in a curved position by tightening the strap; and wherein the collecting plate is movable between a strapping position in the inside area of the guide and a stacking position arranged to permit stacking of the bank notes thereon by a stacking device.

13. The bank note processing machine according to claim 12, further comprising an operating unit arranged to perform a strapping process manually in the inside area.

14. A bank note processing machine, comprising:

a transport device arranged to transport a plurality of bank notes; and a strapper arranged to strap a plurality of bank notes and including a rack with a guide, an inside area surrounded by the guide, a collecting plate arranged to support a bundle of bank notes and having a depression formed on a bottom surface thereof, and a separate welding plate rigidly mounted on the rack, the welding plate is received within the depression of the collecting plate and arranged for contact with a welding element provided for welding portions of the strap, the collecting plate being slideable on the welding plate;

wherein said guide is arranged to form a strap loop around a bundle of bank notes placed in the inside area, and includes strap holding elements arranged to hold a strap only at lateral edge areas thereof upon insertion of the strap into the guide, whereby after insertion of the strap in the guide, the strap is pulled out of the guide into the inside area around the bank-note bundle.

15. The bank note processing apparatus according to claim 14, wherein the collecting plate is movable between a strapping position in the inside area of the guide and a stacking position arranged to permit stacking of the bank notes thereon by a stacking device.

16. The bank note processing machine according to claim 14, further comprising an operating unit arranged to perform a strapping process manually in the inside area.

17. A bank note processing machine, comprising:

a strapper configured to strap a plurality of bank notes, including a rack with a guide and an inside area surrounded by the guide, wherein said guide is arranged to form a strap loop around a bundle of bank notes placed in the inside area, and includes strap holding elements arranged to hold a strap only at lateral edge areas thereof upon insertion of the strap into the guide, wherein after insertion of the strap in the guide, the strap is pulled out of the guide into the inside area around the bank-note bundle;

a collecting plate arranged to receive the bank notes and the collecting plate having a depression formed on a bottom surface; and a separate welding plate rigidly mounted on the rack, the welding plate is received within the depression of the collecting plate and the welding plate is arranged for contact with a welding element provided for welding portions of the strap, the collecting plate being slidable on the welding plate; and two vibration elements acting in different directions for flush alignment of the bank notes stacked on the collecting plate in both longitudinal and transverse directions.

18. The bank note processing apparatus according to claim 17, wherein the collecting plate is movable between a strapping position in the inside area of the guide and a stacking position arranged to permit stacking of the bank notes thereon by a stacking device.

19. The bank note processing machine according to claim 17, further comprising an operating unit arranged to perform a strapping process controlled by the user for strapping bank-note packets brought into the inside area manually.

* * * * *